US005815761A

United States Patent [19]

Haruta et al.

[11] Patent Number: 5,815,761

[45] Date of Patent: Sep. 29, 1998

[54] FILM SHEET HOLDER HANDLING APPARATUS AND METHOD OF HANDLING FILM SHEET HOLDER

[75] Inventors: Yuji Haruta; Nobuaki Nakaoka, both of Wakayama, Japan

[73] Assignee: Noritsu Koki Co., Ltd., Wakayama, Japan

[21] Appl. No.: 780,873

[22] Filed: Jan. 9, 1997

[30] Foreign Application Priority Data

Jan. 12, 1996 [JP] Japan ..... 8-003514

[51] Int. Cl.[6] ..... G03D 13/00; G03D 3/08

[52] U.S. Cl. ..... 396/567; 396/612; 355/133; 206/455

[58] Field of Search ..... 355/40, 75, 64, 355/77, 133; 396/567–570, 612; 206/455

[56] References Cited

U.S. PATENT DOCUMENTS 4,720,733 1/1988 Ohtake et al. ..... 355/77
4,966,285 10/1990 Otake et al. ..... 206/455
5,031,773 7/1991 Manico et al. ..... 355/64

FOREIGN PATENT DOCUMENTS 5011428 1/1993 Japan .
6161087 6/1994 Japan .

*Primary Examiner*—D. Rutledge
*Attorney, Agent, or Firm*—Felfe & Lynch

[57] ABSTRACT

A film sheet holder handling apparatus 100 takes up a film sheet holder 4 in which photographic film strips 5 cut by the unit of one consumer's order amount are inserted into independent rows of pockets of the holder. The apparatus includes a film detecting sensor 19 for detecting presence/absence of the transported film sheet holder 4, a take-up member 30 for taking up the holder 4 by a predetermined amount corresponding to certain number of rows of the holder, and a push-out bar 41 for pushing out the holder 4 from the take-up member 30 after completion of the take-up operation by the take-up member 30 in a direction normal to the direction of transporting the holder 4.

11 Claims, 12 Drawing Sheets

FILM SHEET HOLDER HANDLING APPARATUS AND METHOD OF HANDLING FILM SHEET HOLDER

BACKGROUND OF THE INVENTION

1. Field of the Invention

The present invention relates to an apparatus and method for taking up a film sheet holder in which photographic film strips cut for one order amount are stored.

2. Description of the Related Art

A photographic film after developing and printing processes (to be referred to just as 'film' when appropriate hereinafter) is cut into pieces each containing e.g. four or six frames. Then, these film pieces corresponding to one consumer order amount are inserted into individual pockets (rows) of a foldable film sheet holder to be stored therein. After this, the holder is folded and inserted into a bag together with corresponding prints to be returned to the consumer. The term: 'one order amount' used herein is understood to refer to the amount of film housed within one film patrone or cartridge.

Conventional apparatuses for automatically folding the film sheet holder are known from the Japanese laid-open patent gazette No. 5-011428 (to be referred to as 'reference 1' hereinafter) and from the Japanese laid-open patent gazette No. 6-161087 (to be referred to as 'reference 2' hereinafter). Before folding the film sheet holder, it is desirable to determine in advance whether to fold this holder or not, by detecting arrival of transported film sheet holder and also detecting presence/absence of film within the holder based on the arrival detection. With this, subsequent operations including transporting, taking up and discharging of the film sheet holder may be effected properly.

However, though disclosing the apparatus for folding a film sheet holder, the apparatus of reference 1 does not effect the detection of the film sheet holder. Also, reference 2 discloses, in its accompanying FIG. 11, an optical sensor unit including a light transmitter 188 and a light receiver 189, but this sensor unit is used only for forming a loop of the film sheet holder 26*a*. Accordingly, with these conventional apparatuses, the subsequent operations including transporting, taking up and discharging of the film sheet holder cannot be effected properly. In this respect, there has been room for improvement. Moreover, in the case of the apparatus of reference 2, the holder transporting direction is not changed before and after the holder folding operation, thus tending to invite enlargement of the entire apparatus. Further, the folding apparatuses disclosed in references 1 and 2 both are complicated in construction and large in physical size. Hence, in this respect too, there has been need for improvement. In addition to the above, with the apparatuses of references 1 and 2, no detection is made for the presence or absence of a film held in the film sheet holder. Thus, there has been the inconvenience of a holder not holding any film therein too being unnecessarily taken up by the apparatus.

In view of the above-described state of the art, one object of the present invention is to improve the efficiency of the operation involving the taking up (or folding) of the film sheet holder, by selectively not taking up any holders that need not be taken up.

Another object of the present invention is to provide a film sheet holder handling (taking up or folding) apparatus which is simple in construction and compact in the physical size.

SUMMARY OF THE INVENTION

For accomplishing the above and other objects, according to one aspect of the present invention, a film sheet holder handling apparatus for taking up a film sheet holder in which photographic film strips cut for one order amount are stored, comprises:

take-up means for taking up the film sheet holder by a predetermined amount corresponding to certain number of rows of the film sheet holder; and film detecting means for detecting presence/absence of the film within the transported film sheet holder before the holder is taken up by the take-up means.

The function and effect resulting from the above construction are as follows.

Before the film sheet holder is folded, the film detecting means detects presence/absence of the film. Based on this detection, it is possible to determine in advance whether the transported film sheet holder is to be folded or not. Accordingly, the series of operations relating to the film sheet holder may be effected appropriately.

According to a further aspect of the present invention, the film sheet holder handing apparatus further comprises:

transporting means for transporting the film sheet holder to the take-up means along a transport passage when the film detecting means detects presence of the film; and second discharging means for discharging the film sheet holder along the transport passage when the film detecting means detects absence of the film.

With the above construction, the apparatus takes up not all the transported sheet holders but only one or those holders storing the film therein. And, the former holders which need not be taken up are just discharged along the transport passage. That is, since those holders which do not require such subsequent operations as sorting and verifying operations are discharged without being taken up, as a result, the entire operational efficiency is improved.

Preferably, the film sheet holder handling apparatus further comprises:

sheet detecting means for detecting presence/absence of the transported film sheet holder, wherein the film detecting means becomes operable when the sheet detecting means detects presence of the film sheet holder.

With the above construction, first, the sheet detecting means detects arrival of a film sheet holder. In synchronism with this detection of the film sheet holder, the film detecting means effects detection of presence/absence of the film. That is, the film sheet holder often has a printed surface. And, it is preferred, with respect to detection precision, to effect the detection at a position other than such printed surface portion. With the above, the presence/absence detection of the film may be effected more reliably.

According to a still further aspect of the present invention, the film detecting means includes a plurality of sensors arranged along a width of the film sheet holder being transported, and the film detecting means effects the detection in the first row of the film sheet holder.

As illustrated in FIG. 2, it sometimes happens that a relatively short film strip is stored in the first row. In such case too, by providing the plurality of sensors, the film presence/absence detection may be effected in a reliable manner. Further, as the film presence/absence detection is made at the first row of the holder which is the leading end in the transporting direction thereof, it is possible to determine whether to take up the film sheet holder or not at the early timing. This too may improve the operational efficiency.

Preferably, the take-up means includes a pair of take-up bars arranged eccentrically relative to a common revolution axis, so that a leading end of the film sheet holder is inserted between the pair of take-up bars and the first row of the film sheet holder is taken up in association with concentric revolution of the take-up bars for pushing the first row of the film sheet holder.

That is, with the above construction, the film sheet holder may be taken up by the simple action of the concentric revolution of the pair of take-up bars. This construction is more simple than the conventional construction, so that the entire apparatus may be formed compact.

Preferably, said each take-up bar includes anti-slip means formed of a rubber element at a portion of the bar contacting the film sheet holder.

With the above construction, the take-up operation may be effected reliably without slippage of the holder during this operation.

Further preferably, the pair of take-up bars selectively assume a first posture for allowing insertion therebetween of the leading end of the film sheet holder and a second posture for allowing discharge of the taken-up film sheet holder from the take-up bars.

With the above construction, for inserting the film sheet holder between the pair of take-up bars, the take-up bars assume the first posture in which the bars are disposed one above the other across the transport passage. For discharging the taken-up film sheet holder, the take-up bars assume the second posture for orienting the film face parallel with the transport passage, so that the subsequent handling of the film sheet holder may be facilitated.

According to a still further aspect, the film sheet holder handling apparatus further comprises:

first discharging means for discharging the film sheet holder after the take-up operation thereof by the take-up means;

the first discharging means including a push-out bar for pushing out the taken-up film sheet holder in a direction normal to the transporting direction of the film sheet holder, the push-out bar selectively assuming an inoperative position away from an operational region of the take-up means during its take-up operation of the film sheet holder and an operative position for pushing out the taken-up film sheet holder after completion of the take-up operation.

With the above, since the first discharging means is located away from the operational region of the take-up means during its take-up operation, the first discharging means does not interfere with the take-up operation, so that the take-up operation may take place in a reliable manner.

Moreover, the further feature of the push-out bar pushing out the holder after completion of the take-up operation away from the take-up means in the direction normal to the holder transporting direction, may contribute further compactness of the entire apparatus.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of a film sheet holder handling apparatus relating to the present invention will now be described in details with reference to the accompanying drawings.

Figure 1:
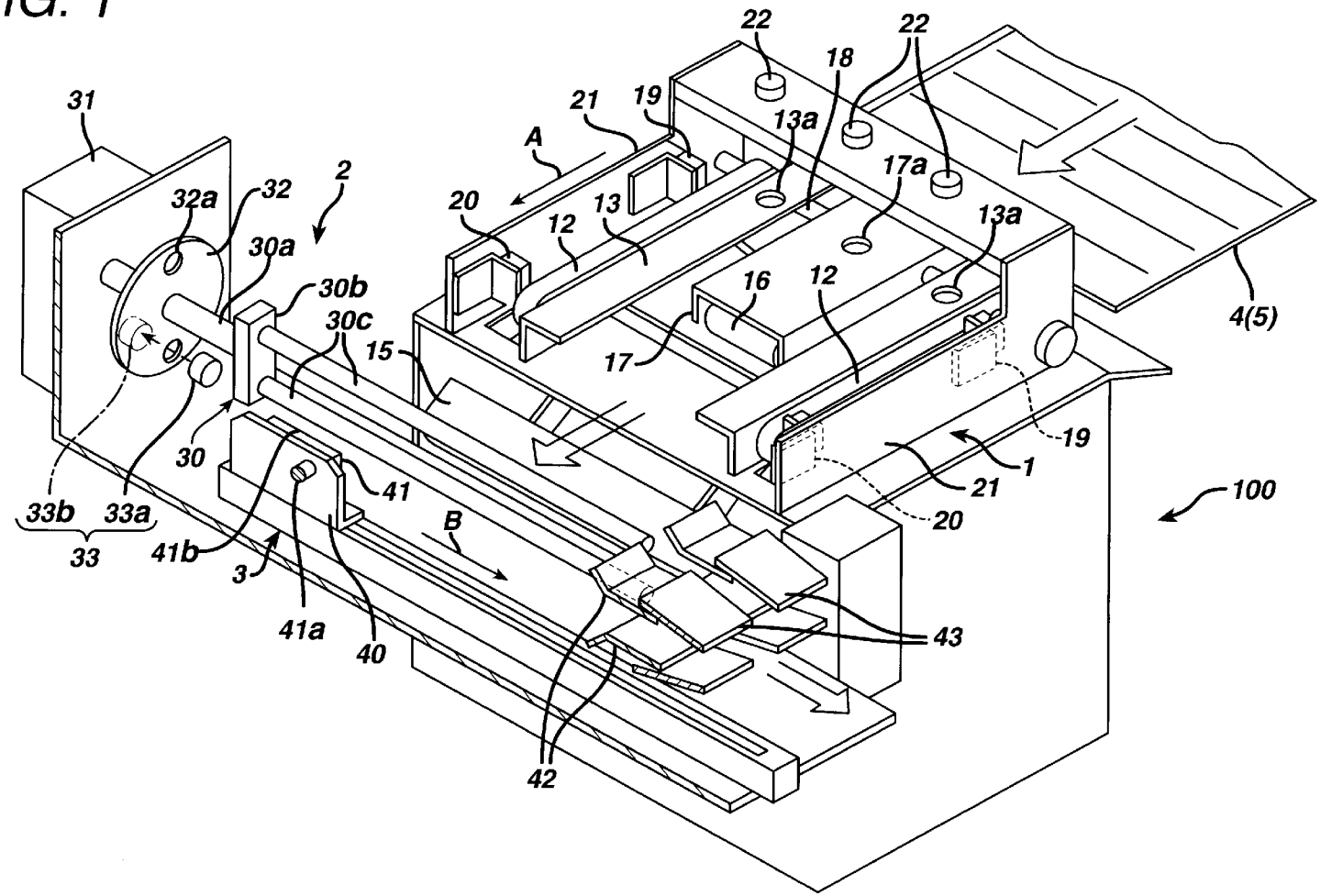
FIG. 1 is a perspective view showing an outer appearance of a negative sheet holder handling apparatus.
Figure 2:
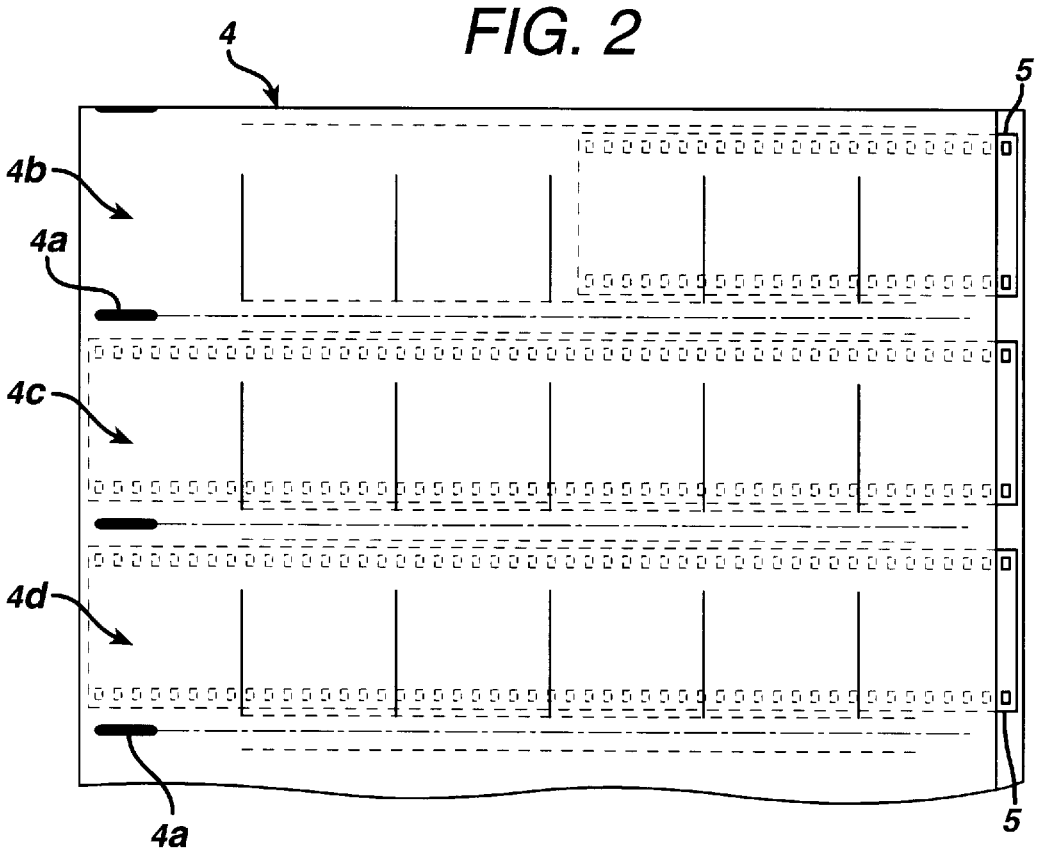
FIG. 2 is a plan view showing a negative sheet holder.
Figure 4:
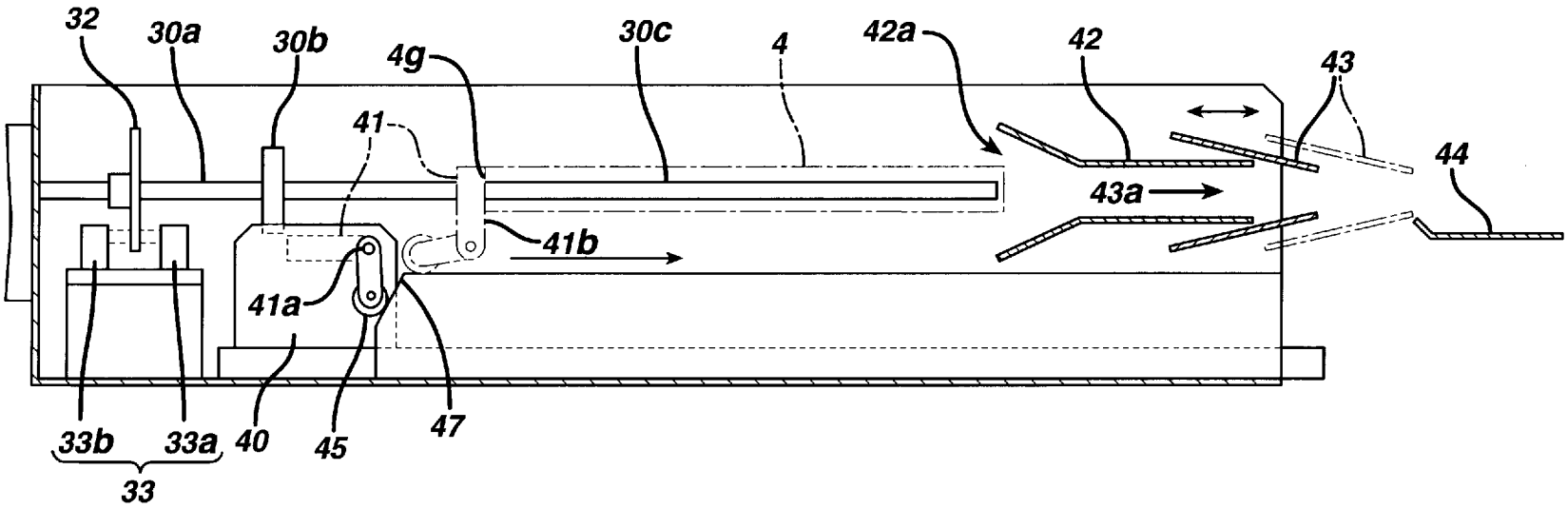
FIG. 4 is a front view showing principal portions of the negative sheet holder handling apparatus.

FIG. 1 is a perspective view showing principal portions of a negative sheet holder handling apparatus 100 as one preferred embodiment of the film sheet holder handling apparatus relating to the present invention. In this apparatus, a transporting unit 1 effects transportation of a negative sheet holder 4 along a direction denoted with an arrow A in FIG. 1. The negative sheet holder 4, as one example of film sheet holder, has a configuration as shown in FIG. 2, in which a developed negative film 5 is cut into a plurality of film strips including 4 to 6 frames (six frames in this figure), and these film strips are sorted along the longitudinal direction of the film 5 for their storage in the holder 4. For this purpose, the negative sheet holder 4 includes a plurality of independent pocket rows 4*b*, 4*c* 4*d* . . . , with a negative sheet mark 4*a* being provided between adjacent rows. In the transporting unit 1, the negative sheet holder 4 is transported with its first row 4 being at the leading end. A take-up unit 2 is provided for taking up the transported negative sheet holder 4 by each row thereof. A discharging unit 3 is provided for discharging the taken-up holder 4 onto a receiver plate 44, which is shown in FIG. 4.

Next, the respective components will be described in details.

Figure 3:
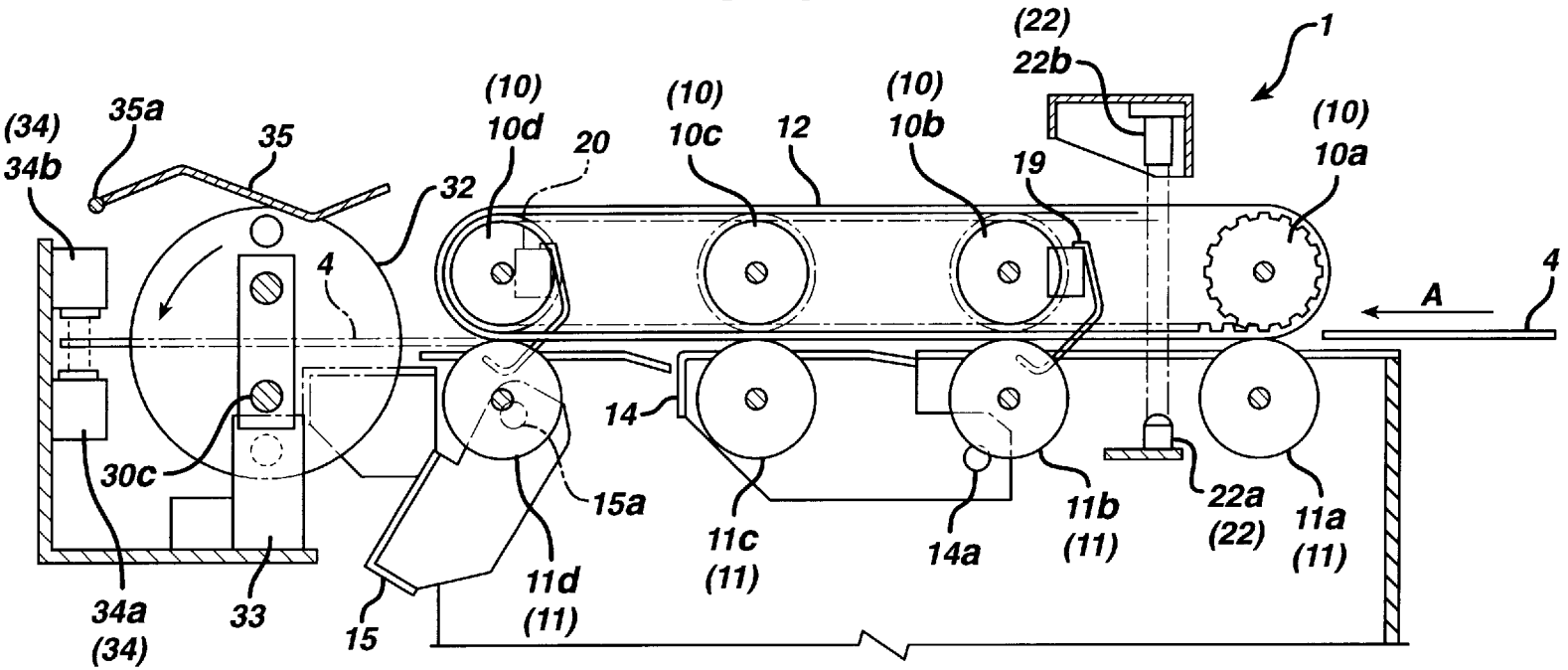
FIG. 3 is a side view showing principal portions of the negative sheet holder handling apparatus.

The transporting unit 1 includes a pair of right and left drive roller groups 10 disposed side by side across a transporting direction for together pinching the sheet holder 4 and transporting this holder 4 (in cooperation with a driven roller group 11 to be described later). Since the constructions of the drive roller groups (also the driven roller groups described later) on the two sides are identical to each other, only one group on one side will be described next. As shown in FIG. 3, the drive roller group 10 include four drive rollers 10*a*, 10*b*, 10*c* and 10*d*, about which an endless belt 12 is entrained, so that the rollers are driven via the belt 12 by e.g. an unillustrated motor. Further, these rollers 10 are rotatably mounted to a mount plate 13 having an 'L'-shaped cross section. Under each drive roller group 10, there is disposed the cooperating driven roller group 11, which includes four driven rollers 11*a*, 11*b*, 11*c* and 11*d* in correspondence with the four drive rollers 10*a*, 10*b*, 10*c* and 10*d*.

To the one driven roller 11*c*, a discharging guide 14 is provided integrally therewith, with the driven roller 11*c* and the discharging guide 14 being pivotable about a pivot axis 14*a*. Normally, the driven roller 11*c* and the guide 14 are located at a position for guiding the negative sheet holder 4 to the take-up unit 2, as illustrated in FIG. 3. On the other hand, for discharging the negative sheet holder 4 away from the transporting passage, the discharging guide 14 is pivoted counter-clockwise, whereby the negative sheet holder 4 is allowed to be discharged off the transport passage. In the vicinity of the driven roller 11*d* which is disposed most downstream along the transport passage, a guide unit 15 is supported to be pivotable about a pivot shaft 15*a*. Normally, this guide unit 15 is located at a position retracted from the transport passage as shown in FIG. 3. For transporting the sheet holder 4 to the take-up unit 2, the guide unit 15 is pivotally driven clockwise to a position facing the transport passage.

Referring back to FIG. 1, at a center between the drive roller groups 10 disposed side by side, there is provided a press roller 16. This press roller 16, when the discharging guide 14 is activated, discharges the negative sheet holder 4 away from the transport passage. The press roller 16 is rotatably supported at a leading end of a mount plate 17, which in turn is supported to be pivotable about a pivot shaft 18. In the instant embodiment, this press roller 16 is supported by the pivot shaft 18 with a spacing from the transport passage corresponding to the thickness of the negative sheet holder 4. Alternatively, the press roller 16 may be urged by means of e.g. an unillustrated spring downwards from the transport passage.

Further outwardly of the right and left drive roller groups 10, as also shown in FIG. 1, detecting switches 19 for detecting presence/absence of the negative sheet holder 4 and further detecting switches 20 for detecting the leading end of the negative sheet holder 4 are attached to respective side plates 21. In this embodiment, these switches 19, 20 are comprised of limit switches. Alternatively, these switches may be comprised of optical sensors. Further alternatively, these switches 19, 20 may be respectively provided on one side plate 21 alone. On the upstream side in the transporting direction of the negative sheet holder 4, there are provided negative sensors 22 for detecting presence/absence of the negative film 5 stored in the negative sheet holder 4. Each of these negative sensors 22, as shown in FIG. 3, is comprised of a beam emitter 22*a* and a beam receiver 22*b* arranged one above the other across the transport passage. Incidentally, the disposing positions of these beam emitter 22*a* and the beam receiver 22*b* may be reversed from each other. Three of these negative sensors 22 are provided at three positions along the width of the transported negative sheet holder 4. Further, in order not to interrupt the beam path from the beam emitter 22*a* to the beam receiver 22*b*, the mount plate 13 and the mount plate 17 respectively define slots 13*a*, 17*a*. These negative sensors 22 are provided for detecting presence/absence of the negative film 5 within the first pocket row 4*b* of the negative sheet holder 4. As there is the possibility of the first pocket row 4*b* of the holder 4 storing therein a strip of the film 5 shorter than six frames, three of these sensors 22 are provided in order to provide reliable detection.

Here, the detecting switch 19 functions a sheet detecting means for detecting presence/absence of the transported negative sheet holder. And, the negative sensors 22 together function as a film detecting means for detecting presence/absence of a film stored within a film stored within a transported negative sheet holder 4. The drive roller groups 10, the driven roller groups 11 and the belt 12 together function as a transporting means for transporting the negative sheet holder 4 along the transport passage to the take-up means when the film detecting means detects presence of the film within the holder 4. The press roller 16 functions as a second discharging means for discharging the negative sheet holder 4 from the transport passage when the film detecting means detects absence of the film 5 in the holder 4.

The take-up unit 2 includes a take-up member 30 for taking up the negative sheet holder 4 by an amount corresponding to each row thereof, with the take-up member 30 being rotatably attached to a drive unit 31. The take-up member 30 integrally includes a drive shaft 30*a* connected with a motor housed within the drive unit 31, a rectangular-shaped connecting portion 30*b* attached to the leading end of the drive shaft 30*a* and a pair of take-up bars 30*c*. As shown in FIG. 3, the pair of take-up bars 30*c* are arranged away from the rotational axis by a predetermined distance, respectively. The bars 30*c* respectively have a thin, long and round cylindrical shape having a sufficient length for taking up the negative sheet holder 4 about the bars. The drive shaft 30*a* rigidly mounts thereon a disc 32, which defines holes 32*a* at two peripheral portions of the disc equi-distantly apart from each other. And, as shown in FIGS. 3 and 4, at a position which may come into registry with each of the holes 32*a* of the disc 32 in association with rotation thereof, there is provided an END sensor 33 comprised of a beam emitter 33*a* and a beam receiver 33*b*. With this, the rotation of the take-up member 30 may be controlled. Further, as shown in FIG. 3, downstream of the take-up member 30, there is provided an optical sensor 34 including a beam emitter 34*a* and a beam receiver 34*b* for detecting the leading end of the negative sheet holder 4. Upwardly of the take-up member 30, there is provided a sheet pressing plate 35. This sheet pressing plate 35 is pivotable about a pivot shaft 35*a* between a retracted inoperative position shown in FIG. 3 and an operative position for securely pressing the negative sheet holder 4.

The take-up member 30 described above functions as a take-up means for taking up the film sheet holder by a predetermined amount corresponding to certain number of row(s) of the film sheet holder.

Figure 16:
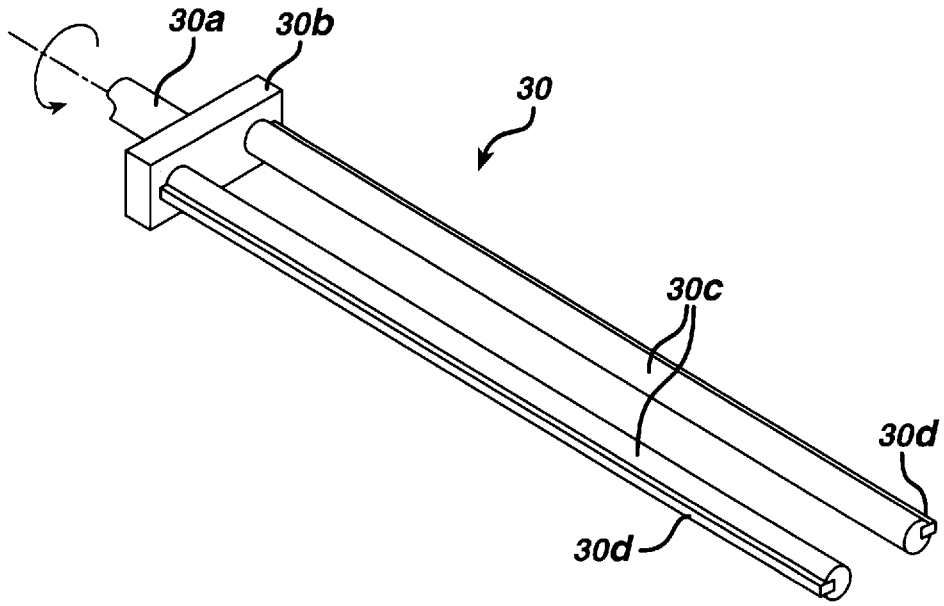
FIG. 16 shows shapes of take-up bars according to one preferred mode thereof.

As a preferred construction of the pair of take-up bars 30*c*, as shown in FIG. 16, each cylindrical bar 30*c* defines a groove at an outer periphery thereof, in which a rubber element 30*d* acting as an anti-slip means is embedded. And, the respective bars 30*c* are disposed at the extreme opposed ends of the connecting portion 30*b* most distant from the rotational axis of the take-up member 30. Alternatively, a tubular rubber element may be wound about the entire outer periphery of the take-up bar 30*c*. Further, any other material or construction may be employed if it has a large coefficient of friction for effectively restricting slippage of the negative sheet holder 4 in the course of the take-up operation.

As shown in FIGS. 1 and 4, the discharging unit 3 includes a push-out bar 41 for pushing out the negative sheet holder 4 from the take-up member 30, the push-out bar 41 being supported to a support plate 40 to be pivotable about a shaft 41*a* and pivotally urged counter-clockwise by means of an unillustrated spring. This push-out bar 41 has a substantially rectangular shape having a contact face 41*b*.

Normally, the push-out bar 41 is held in such a posture as to orient its contact face 41*b* parallel with the plane of the transport passage as shown in FIG. 1. For discharging the negative sheet holder 4, the push-out bar 41 is pivotally driven, by means of a cam having an inclined face 47, to a position where the contact face 41*b* extends perpendicular to the transport passage plate. The discharging direction of the negative sheet holder 4 is indicated by an arrow B in FIG. 1, and this discharging direction extends normal to the transporting direction of the negative sheet holder 4.

Accordingly, the push-out bar 41 functions as a first discharging means for discharging the film sheet holder 4 after completion of its take-up operation by the take-up means described above.

On the downstream side in the discharging direction of the negative sheet holder 4, there are disposed a stationary guide 42, a movable guide 43 and the receiver plate 44, in the mentioned order. An entrance 42*a* of the stationary guide 42 and an entrance 43*a* of the movable guide 43 are formed as inclined faces for facilitating introduction of the taken-up negative sheet holder 4. The movable guide 43 is normally retained to the stationary guide 42. But, for discharging the negative sheet holder 4 onto the receiver plate 44, the movable guide 43 is slided toward the receiver plate 44. This receiver plate 44 receives thereon one order amount of negative sheet holder 4.

Next, the operations of the negative sheet holder handling apparatus 100 having the above-described construction will be described in details with reference to operation-illustrating views of FIGS. 5 through 13 and also an operation illustrating flow chart of FIGS. 14(*a*) and 14(*b*). Incidentally, these series of operations are controlled by means of a control unit having a microcomputer as a major component thereof.

Figure 5:
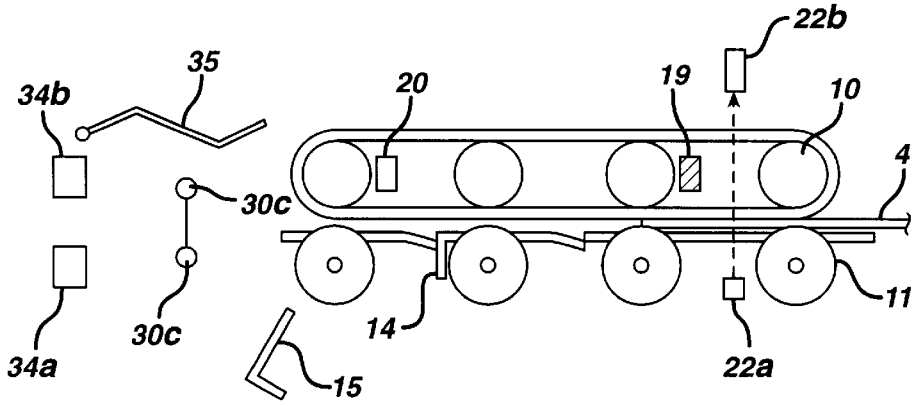
FIG. 5 is a first operation-illustrating view of the handling apparatus.

As shown in FIG. 5, when the negative sheet holder 4 cut into one order amount is transported, this holder 4 activates a lever or the like of the detecting switch 19, so that the arrival of the transported negative sheet holder 4 may be detected (step #100). Then, based on this detection by the detecting switch 19, the negative sensor 22 is turned ON, then, this sensor 22 detects presence/absence of a negative film strip 5 within the first row pocket 4*b* of the holder 4 (step #101). By synchronizing the detection operation by the negative sensor 22 with the operation of the detecting switch 19, the detection of the negative film 5 may be effected in a reliable manner. This is because the negative sheet holder 4 usually has some printing on the surface thereof and the above construction allows the detection of presence/absence of the negative film 5 at a portion free from such printing. To do this, the detecting switch 19 and the negative sensor 22 should be arranged appropriately with a predetermined distance therebetween.

Figure 6:
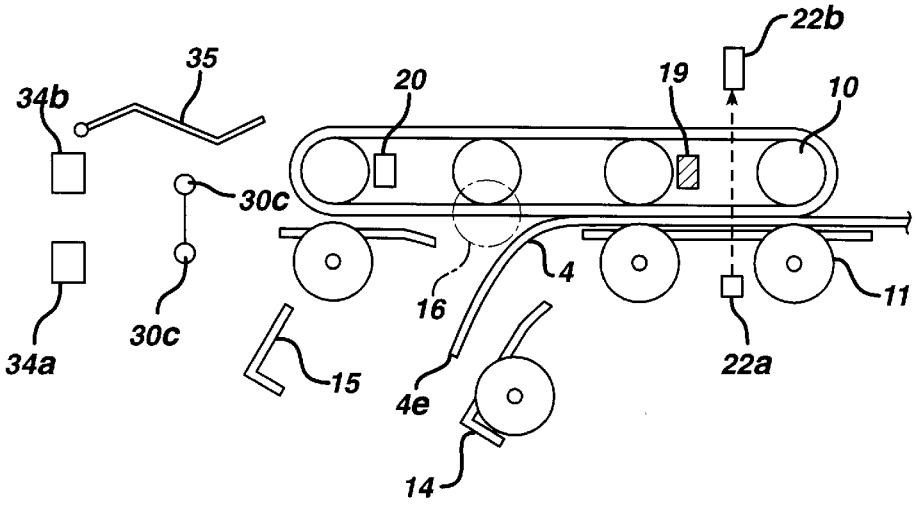
FIG. 6 is a second operation-illustrating view of the handling apparatus.

If the negative sensor 22 detects absence of the negative film strip 5 in the first row pocket 4*b* of the holder 4, then, the discharging guide 14 is activated even if the negative film strips 5 are inserted into the second or subsequent rows 4*c*, 4*d* . . . (step #117). This is because the take-up unit 2 is disabled from taking up the negative sheet holder 4 if no negative film strip 5 is present in the first row 4*b* of the holder 4. Further, the detection at the first row 4*b* is advantageous for allowing early determination on whether to discharge the holder 4 or not. The discharging guide 14 is pivotally driven counter-clockwise about the pivot shaft 14*a* from position shown in FIG. 5 to the further position shown in FIG. 6 retracted away from the transport passage. In association with this operation of the discharging guide 14, the press roller 16 too is driven counter-clockwise by its own weight or by means of an urging force from an unillustrated spring, so as to move the leading end 4*e* of the negative sheet holder 4 from the transport passage to a discharge passage. In the condition of FIG. 6, if the drive roller group 10 is further driven, the negative sheet holder 4 is completely discharged from the transport passage. Under the transport unit 1, there is provided a tray for receiving the discharged negative sheet holder 4.

Figure 7:
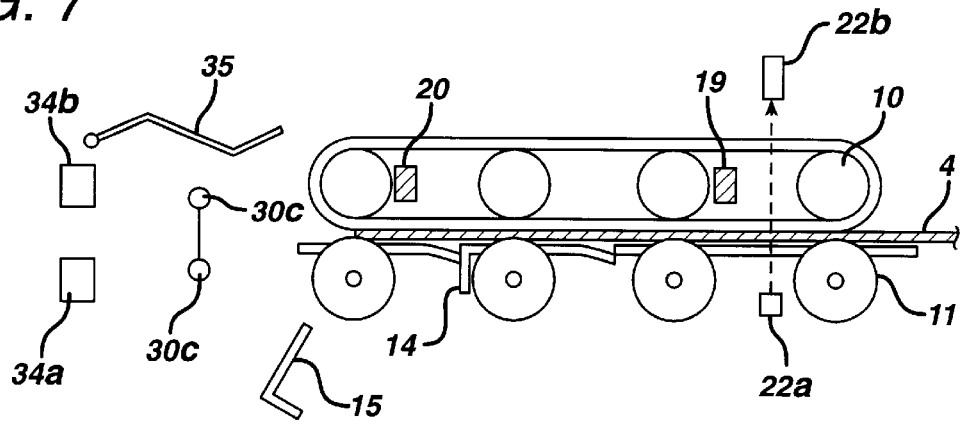
FIG. 7 is a third operation-illustrating view of the handling apparatus.
Figure 8:
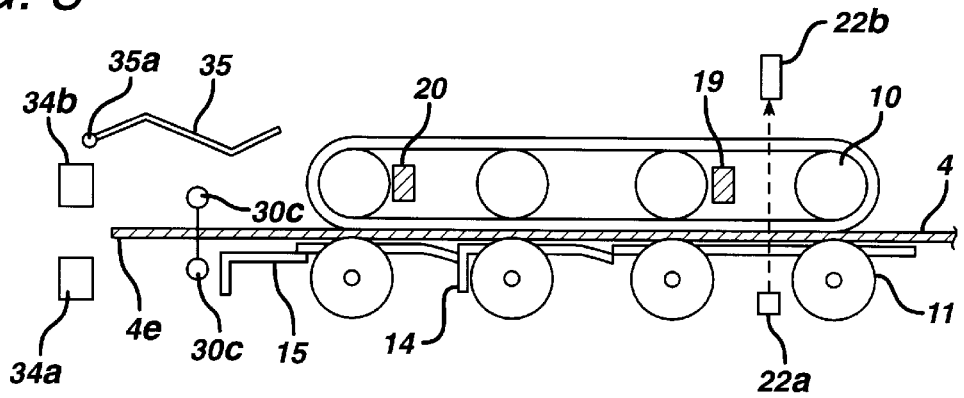
FIG. 8 is a fourth operation-illustrating view of the handling apparatus.

Next, if the negative sensor 22 detects presence of the negative film strip 5 within the first row 4*b* of the holder 4, then, this holder 4 is transported. Then, as shown in FIG. 7, when the leading end 4*e* of the holder 4 comes to the position of the detecting switch 20, the leading end 4*e* activates the lever of the detecting switch 20, whereby the arrival of the leading end 4*e* of the negative sheet holder 4 is detected (step #102). Based on this detection result, as shown in FIG. 8, the guide 15 is pivotally driven clockwise about the pivot shaft 15*a* from the retracted position shown in FIGS. 5 through 7 to the guiding position (step #103). This arrangement of normally retracting the guide 15, the take-up member 30 may be disposed closer to the transport unit 1, thereby to allow the entire handling apparatus compact.

Figure 9:
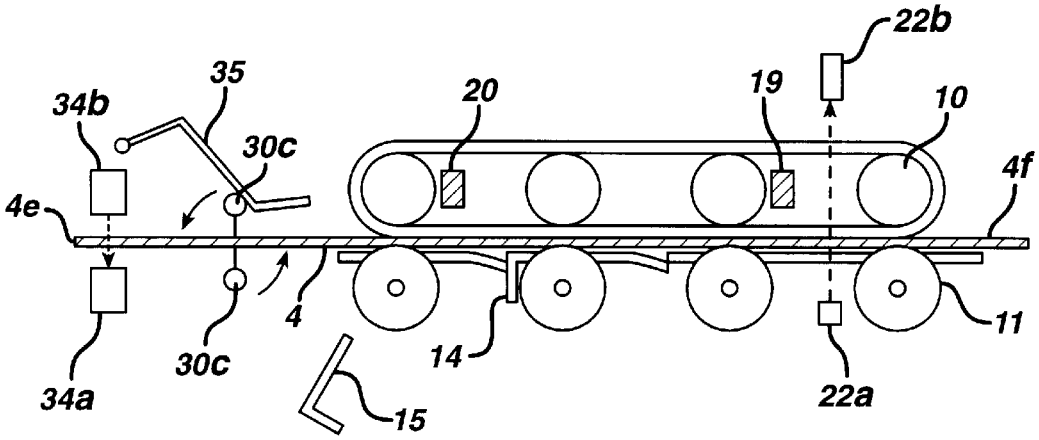
FIG. 9 is a fifth operation-illustrating view of the handling apparatus.

With the guide 15 being retained at the guiding position, if the negative sheet holder 4 is further transported, then, as shown in FIG. 8, the leading end 4*e* of the holder 4 is inserted between the pair of take-up bars 30*c*. Prior to the take-up operation, the pair of take-up bars 30*c* are arranged one above the other across the transport passage. Then, as shown in FIG. 9, the leading end 4*e* of the negative sheet holder 4 is detected by the sensor 34 (step #104). Based upon this detection result by the sensor 34, the guide 15 is again returned from the guiding position to the retracted position (step #105). This returning operation is done for the purpose of not interfering with the subsequent take-up operation.

Incidentally, instead of providing the sensor 34 described above, it is also conceivable to provide means capable of detecting a feed amount of the negative sheet holder 4, so that after the detection of the leading end 4*e* by the detecting switch 20, transportation of the holder 4 by a predetermined amount (set to one row: about 50 mm) will be detected, and based on this detection the guide 15 will be returned to the retracted position.

Now, when the arrival of the leading end 4*e* of the holder 4 is detected based upon the detection by the sensor 34, then, the take-up member 30 is rotated counter-clockwise as indicated by the arrow in FIG. 9 (step #106). The velocity of this rotation is set so as not to apply an excessive tension on the holder 4. In these manners, the first row 4*b* of the negative sheet holder 4 is inserted between the pair of take-up bars 30*c* and then the take-up operation of the negative sheet holder 4 is initiated. The process of this take-up operation is continuously illustrated in FIGS. 15(*a*), (*b*) (*c*) and (*d*). As may be understood from these series of operation illustrating views, with the concentric revolution of the take-up bars 30*c*, this pushes the first row 4*b* of the negative sheet holder 4 to rotate it, whereby the take-up operation proceeds.

Figure 10:
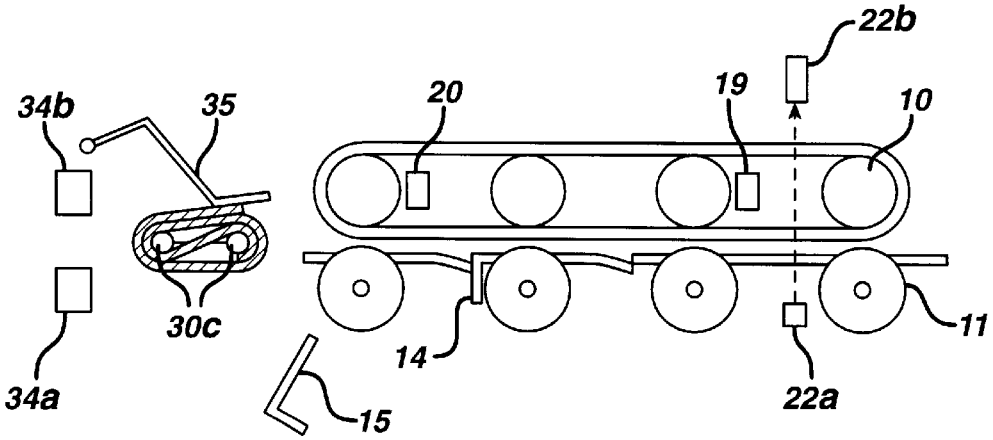
FIG. 10 is a sixth operation-illustrating view of the handling apparatus.
Figure 11:
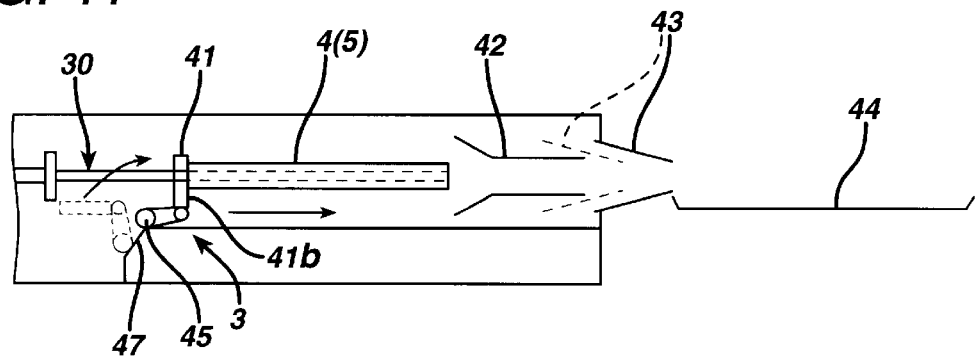
FIG. 11 is a seventh operation-illustrating view of the handling apparatus.

The taken-up condition of the negative sheet holder 4 on the take-up member 30 is illustrated in FIG. 10. At each region between adjacent rows of the negative sheet holder 4, there is formed a linear perforation so allow separation of the holder 4 at this region when necessary. Then, the holder 4 may be taken up by folding it at this perforation. That is, the right and left edges of the taken-up negative sheet holder 4 illustrated in FIG. 10 do not contain the negative film 5, so that these edges are slightly folded. Also, the take-up width is set to substantially correspond to one row of the negative sheet holder 4. Accordingly, the distance between the pair of take-up bars 30*c* too is set so as to provide the above function. Usually, the number of rows of the holder 4 differs for each consumer's order. Therefore, the feature of taking-up the holder 4 by each order amount provides the advantage of allowing setting of same transport conditions for the holder 4.

Incidentally, after the initiation of the take-up operation, the sheet pressing plate 35 is driven clockwise about the pivot shaft 35*a* from the retracted inoperative position shown in FIG. 8 to the operative position shown in FIG. 9 (step #107). As this pressing plate 35 has elastic resilience, the negative sheet holder 4 may be kept pressed by the elastic resilience of the plate 35 during the take-up operation. Further, after completion of the take-up operation too, the plate 35 keeps pressing a rear end portion 4*f* of the negative sheet holder 4 so as to prevent loosening and unwinding of the taken-up negative sheet holder 4.

As the take-up member 30 gradually takes up the negative sheet holder 4, a rear end portion 4*f* of this holder 4 is detected by the detecting switch 20. Then, when the beam transmitted from the beam emitter 33*a* of the END sensor 33 is detected two times by its beam receiver 33*b*, the rotation of the take-up member 30 is stopped (steps #108, #109, #110). More particularly, after the detection by the detection switch 20, the take-up member 30 is rotated for one time. With this, after completion of the take-up operation, the sheet pressing plate 35 may press the holder 4 in such a manner that the rear end portion 4*f* of the holder 4 is oriented upwards. As shown in FIG. 10, upon completion of the take-up operation, the revolution of the pair of take-up bars 30*c* is stopped so that the bars 30*c* may be located horizontally side by side.

Figure 12:
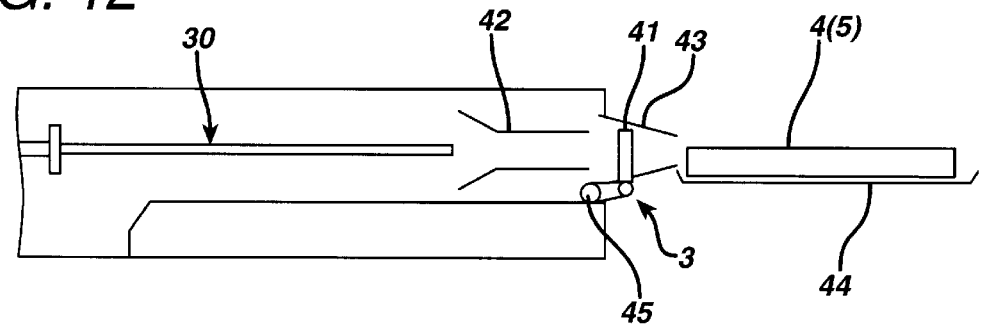
FIG. 12 is an eighth operation-illustrating view of the handling apparatus.

Next, a discharging operation of the taken-up negative sheet holder 4 will be described. Upon completion of the take-up operation of the negative sheet holder 4, that is, upon the detection by the END sensor 33, the movable guide 43 is slided from a position denoted by broken lines in FIG. 11 to a further position denoted by solid lines in the same figure (step #111). Then, a support plate 40 shown in FIG. 1 is slided in the direction of arrow in FIG. 11. In association with this sliding movement, a follower roller 45 connected integrally to the push-out bar 41 is guided by the inclined face 47, whereby the push-out bar 41 is pivoted clockwise. In association therewith, the push-out bar 41 is shifted from the horizontal posture to the vertical posture (step #112). Under this vertical posture, the contact face 41*b* pushes a side end portion 4*g* of the negative sheet holder 4 and the holder 4 is pushed and discharged from the take-up bars 30*c* (step #113). Then, the negative sheet holder 4 is placed on the receiver plate 44, as illustrated in FIG. 12.

Figure 13:
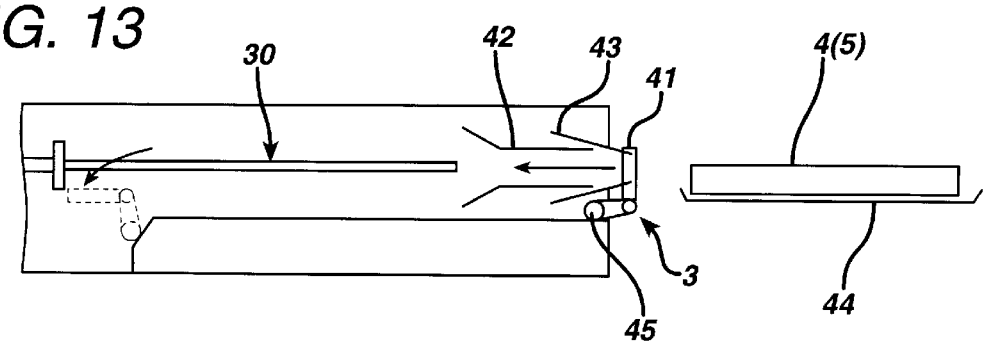
FIG. 13 is a ninth operation-illustrating view of the handling apparatus, FIGS. 14(*a*) and 14(*b*) are a flow chart illustrating the operations of the handling apparatus.
Figure 14A:
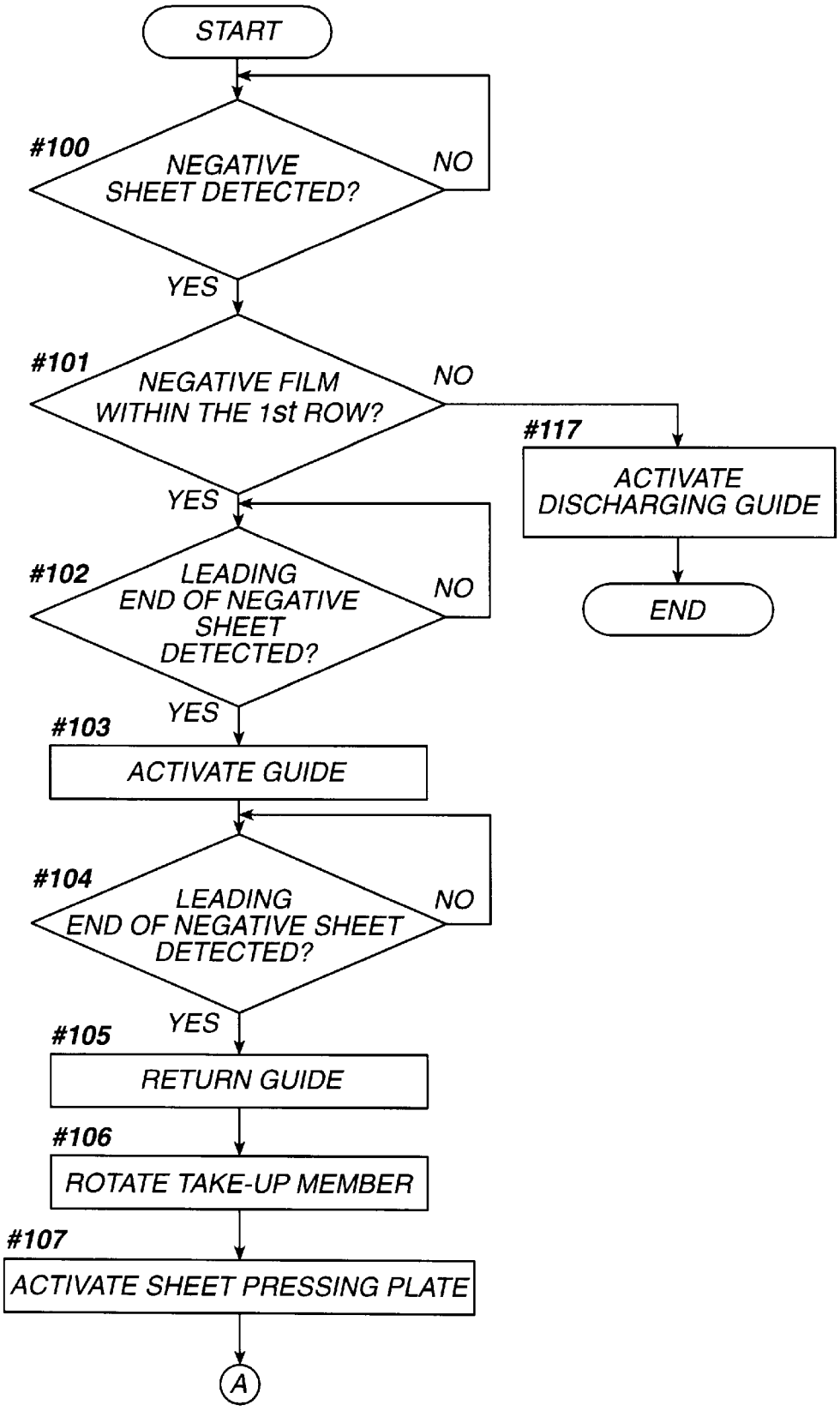
Figure 14B:
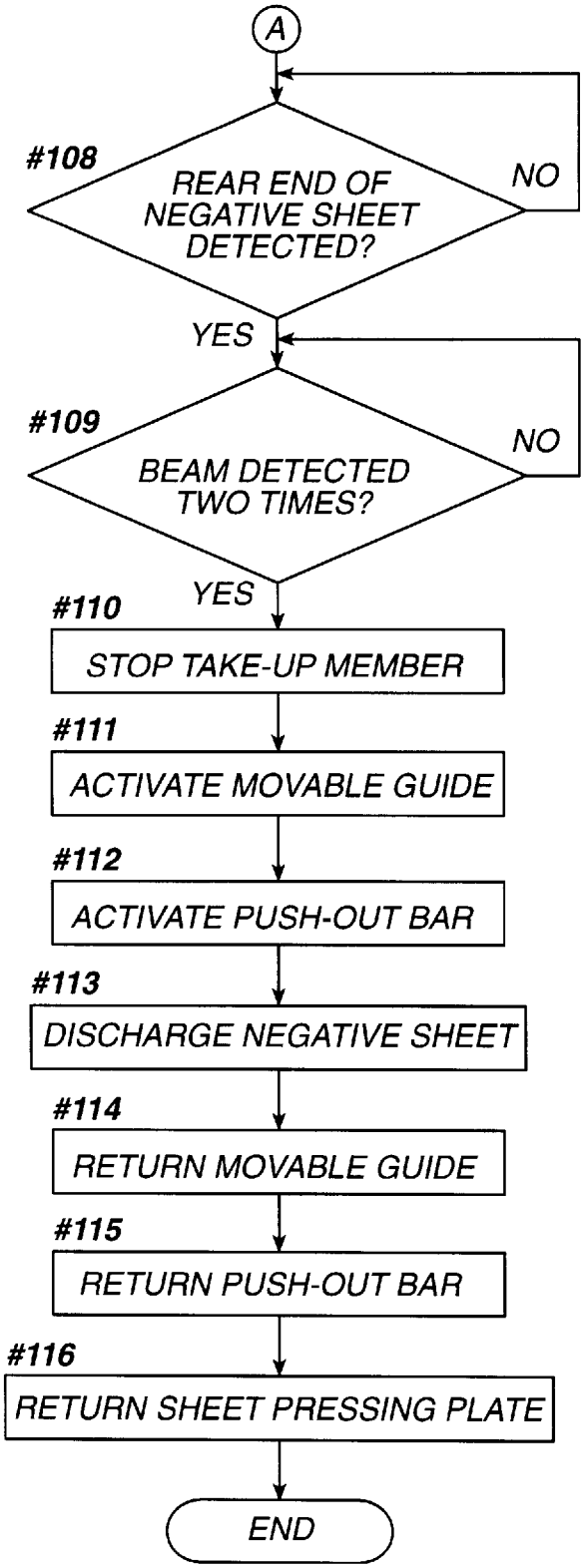
Figure 15A:
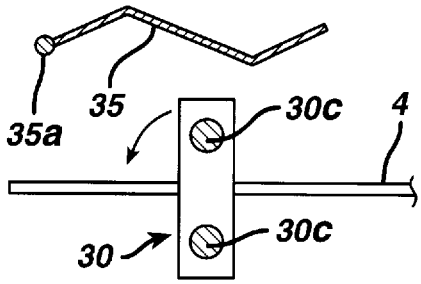
FIG. 15 is a view showing a taken-up condition of the negative sheet holder.
Figure 15B:
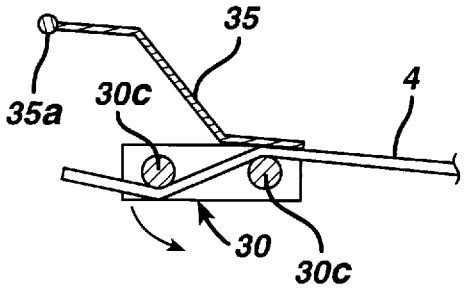
Figure 15C:
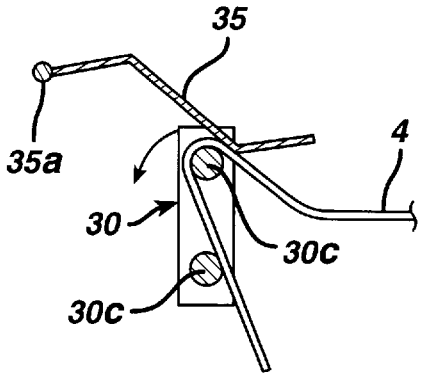
Figure 15D:
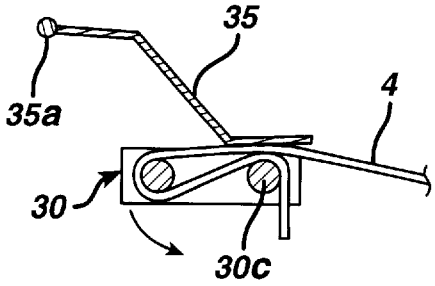

Upon completion of the discharging of the holder 4 onto the receiver plate 44, as illustrated in FIG. 13, the movable guide 43 is returned to the initial position (step #114). Thereafter, the push-out bar 41 too is returned to its initial position (step #115). Further, the sheet pressing plate 35 is returned to the retracted position (step #116). This is the initial condition shown in FIG. 4. Incidentally, the timing of returning the sheet pressing plate 35 is not limited to that described above. This returning operation may be effected anytime after the holder 4 has exited from the take-up bars 30*c*.

The folded negative sheet holder 4 is inserted, at a separate site, into a bag together with its corresponding photographic prints to be provided to the consumer.

Other Embodiments

Next, some other embodiments of the invention will be described.

(1) The method and apparatus of the invention may be used also for positive films, instead of the negative films.

(2) In the foregoing embodiment, the negative sheet holder 4 is bound between the belt 12 entrained about the drive roller group 10 and the driven roller group 11 as the transporting means. Instead, the negative sheet holder 4 may be bound directly between the drive rollers and the driven rollers. Further alternatively, a belt may be entrained also about the driven roller group, so that the negative sheet holder 4 may be bound between the upper belt and the lower belt.

(3) The shape of the take-up bar 30*c* is not limited to the round cylindrical shape described in the foregoing embodiment. Instead, this bar 30*c* may have an angular cylindrical shape.

(4) Although the negative sheet holder handling apparatus of the invention is used as an independent apparatus in the foregoing embodiment, it is needless to say that this apparatus may also be used in combination with a developing/printing device of the negative films 5 or with an apparatus for automatically inserting the negative film 5 into the negative sheet holder 4.

(5) The optical sensors used as examples of the first and second detecting means may be constructed as a beam reflecting type, rather than the beam transmitting type described hereinbefore.

(6) In the foregoing embodiment, the second discharging means discharges the negative film by pushing it. Instead, this second discharging means may be constructed so as to discharge the film by pinching it by means of e.g. a clip.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A film sheet holder handling apparatus for taking up a film sheet holder in which photographer film strips cut for one order amount are stored, comprising:

take-up means for taking up the film sheet holder by a predetermined amount corresponding to a certain number of rows of the film sheet holder;

film detecting means for detecting the presence or absence of the film within the transported film sheet holder before the holder is taken up by the take-up means;

transporting means for transporting the film sheet holder to the take-up means along a transport passage when the film detecting means detects presence of the film; and second discharging means for discharging the film sheet holder from the transport passage when the film detecting means detects absence of the film.

2. A film sheet holder handling apparatus for taking up a film sheet holder in which photographic film strips cut for one order amount are stored, comprising:

take-up means for taking up the film sheet holder by a predetermined amount corresponding to a certain number of rows of the film sheet holder;

film detecting means for detecting the presence or absence of the film within the transported film sheet holder before the holder is taken up by the take-up means; and sheet detecting means for detecting the presence or absence of the transported film sheet holder;

wherein the film detecting means becomes operable when the sheet detecting means detects presence of the film sheet holder.

3. A film sheet holder handling apparatus for taking up a film sheet holder in which photographic film strips cut for one order amount are stored, comprising:

take-up means for taking up the film sheet holder by a predetermined amount corresponding to the certain number of rows of the film sheet holder; and film detecting means for detecting the presence or absence of the film within the transported film sheet holder before the holder is taken up by the take-up means;

wherein the film detecting means includes a plurality of sensors arranged along a width of the film sheet holder being transported, and the film detecting means effects the detection in the first row of the film sheet holder.

4. A film sheet holder handling apparatus for taking up a film sheet holder in which photographic film strips cut for one order amount are stored, comprising:

take-up means for taking up the film sheet holder by a predetermined amount corresponding to a certain number of rows of the film sheet holder; and film detecting means for detecting the presence or absence of the film within the transported film sheet holder before the holder is taken up by the take-up means;

wherein the film detecting means comprises a pair of take-up bars arranged eccentrically relative to a common revolution axis thereof, so that a leading end of the film sheet holder is inserted between the pair of take-up bars and the first row of the film sheet holder is taken up in association with concentric revolution of the take-up bars for pushing the first row of the film sheet holder.

5. The film sheet holder handling apparatus of claim 4, wherein each of said take-up bars comprises anti-slip means formed of a rubber element at a portion of the bar contacting the film sheet holder.

6. The film sheet holder handling apparatus of claim 4, wherein the pair of take-up bars selectively assume a first posture for allowing insertion there between of the leading end of the film sheet holder and a second posture for allowing discharge of the taken-up film sheet holder from the take-up bars.

7. A film sheet holder handling apparatus for taking up a film sheet holder in which photographic film strips cut for one order amount are stored, comprising:

take-up means for taking up the film sheet holder by a predetermined amount corresponding to the certain number of rows of the film sheet holder; and film detecting means for detecting the presence or absence of the film within the transported film sheet holder before the holder is taken up by the take-up means;

first discharging means including a push-out bar for pushing out the taken-up film sheet holder in a direction normal to the transporting direction of the film sheet holder, the push-out bar selectively assuming an inoperative position away from an operational region of the take-up means during its take-up operation of the film sheet holder and an operative position for pushing out the taken-up film sheet holder after completion of the take-up operation.

8. A film sheet holder handling apparatus for taking up a film sheet holder in which photographic film strips cut for one order amount are stored, comprising:

sheet detecting means for detecting the presence or absence of the transported film sheet holder;

take-up means for taking up the film sheet holder by a predetermined amount corresponding to a certain number of rows of the film sheet holder;

first discharging means for discharging the film sheet holder from the take-up means after the take-up operation thereof by the take-up means in a direction normal to a transporting direction of the film sheet holder;

film detecting means for detecting the presence or absence of the film within the transported film sheet holder before the taking-up of the holder;

transporting means for transporting the film sheet holder to the take-up means along a transport passage when the film detecting means detects presence of the film; and second discharging means for discharging the film sheet holder from the transport passage when the film detecting means detects absence of the film.

9. The film sheet holder handling apparatus of claim 8, wherein the film detecting means becomes operable when the sheet detecting means detects presence of the film sheet holder.

10. The film sheet holder handling apparatus of claim 8, wherein the film detecting means comprises a plurality of sensors arranged along a width of the film sheet holder being transported, and the film detecting means effects the detection in the first row of the film sheet holder.

11. A method of handling a film sheet holder handling in which photographic strips cut for one order amount are stored, comprising the steps of:

transporting the film sheet holder;

detecting the presence or absence of the transported film sheet holder;

detecting the presence or absence of a film within the film sheet holder when the presence of the transported film sheet holder is detected;

transporting the film sheet holder to take-up means along a transport passage when presence of the film is detected by said film detecting step; and taking up the film sheet holder by a predetermined amount corresponding to certain number of rows of the film sheet holder.

* * * * *